US008994444B2

(12) United States Patent
Baek et al.

(10) Patent No.: US 8,994,444 B2
(45) Date of Patent: Mar. 31, 2015

(54) PROPORTIONAL TO ABSOLUTE TEMPERATURE CURRENT GENERATION CIRCUIT HAVING HIGHER TEMPERATURE COEFFICIENT, DISPLAY DEVICE INCLUDING THE SAME, AND METHOD THEREOF

(75) Inventors: Seung Hwan Baek, Seoul (KR); Chang Hwe Choi, Yongin-si (KR); Hyung Tae Kim, Hwaseong-si (KR)

(73) Assignee: Samsung Electronics Co., Ltd., Gyeonggi-Do (KR)

( * ) Notice: Subject to any disclaimer, the term of this patent is extended or adjusted under 35 U.S.C. 154(b) by 1602 days.

(21) Appl. No.: 12/149,808

(22) Filed: May 8, 2008

(65) Prior Publication Data

US 2008/0284493 A1 Nov. 20, 2008

(30) Foreign Application Priority Data

May 18, 2007 (KR) ..... 10-2007-0048691

(51) Int. Cl.
*H01L 35/00* (2006.01)
*G05F 3/30* (2006.01)

(52) U.S. Cl.
CPC ..... *G05F 3/30* (2013.01)
USPC ..... 327/513

(58) Field of Classification Search
CPC ..... G05F 3/26; G05F 3/30
USPC ..... 345/204, 211–214; 327/513
See application file for complete search history.

(56) References Cited

U.S. PATENT DOCUMENTS 6,351,111 B1 2/2002 Laraia
6,437,614 B1 * 8/2002 Chen ..... 327/143
6,831,504 B1 12/2004 Holloway et al.
6,933,769 B2 * 8/2005 Koelling ..... 327/538

(Continued)

FOREIGN PATENT DOCUMENTS

CN 1517768 A 8/2004
CN 1658270 A 8/2005

(Continued)

OTHER PUBLICATIONS

Chinese Office Action dated Dec. 16, 2011 issued in corresponding Chinese Appln. No. 200810097181.9.

(Continued)

*Primary Examiner* — Dennis Joseph
(74) *Attorney, Agent, or Firm* — Harness, Dickey & Pierce, P.L.C.

(57) ABSTRACT

A proportional to absolute temperature (PTAT) current generation circuit may include a current mirror unit and/or a level control unit. The current mirror unit may be connected between a first power supply voltage, a first node, and/or a second node. The level control unit may be connected between the first node, the second node, and/or a second power supply voltage. The level control unit may be configured to control a level of an output current of the current mirror unit based on a voltage level of the first node and a voltage level of the second node. The level control unit may include a first transistor connected between the first node and the second power supply voltage, at least one second transistor connected between the second node and a third node, the at least one second transistor configured to operate in a weak inversion region, and/or a third transistor connected between the third node and the second power supply voltage.

6 Claims, 5 Drawing Sheets

(56) References Cited

U.S. PATENT DOCUMENTS

| | | | | |
|---|---|---|---|---|
| 6,954,058 | B2 * | 10/2005 | Ota et al. | 323/315 |
| 2005/0184946 | A1 | 8/2005 | Pyoun et al. | |
| 2006/0007207 | A1 | 1/2006 | Kawaguchi | |
| 2006/0091940 | A1 | 5/2006 | Kimura | |
| 2006/0103455 | A1 | 5/2006 | Zhang et al. | |

FOREIGN PATENT DOCUMENTS

| | | | |
|---|---|---|---|
| CN | 1677474 | A | 10/2005 |
| CN | 1804979 | A | 7/2006 |
| CN | 1908845 | | 2/2007 |
| JP | 2005-338294 | | 12/2005 |
| JP | 2006-133869 | | 5/2006 |
| JP | 2006-146906 | | 6/2006 |
| JP | 2007-52789 | | 3/2007 |
| KR | 10-0596978 | | 6/2006 |
| TW | 200635234 | | 10/2006 |

OTHER PUBLICATIONS

Korean Notice to Submit Response dated Jun. 25, 2008.
Chinese Office Action issued Aug. 12, 2013 for corresponding Chinese Application No. 201110305685.7.
Taiwanese Office Action dated Jan. 10, 2014 for corresponding Taiwan Application No. 97116983.
Abstract of KR 1020060053414 published May 22, 2006.

* cited by examiner

PROPORTIONAL TO ABSOLUTE TEMPERATURE CURRENT GENERATION CIRCUIT HAVING HIGHER TEMPERATURE COEFFICIENT, DISPLAY DEVICE INCLUDING THE SAME, AND METHOD THEREOF

PRIORITY STATEMENT

This application claims the benefit of priority to Korean Patent Application No. 10-2007-0048691, filed on May 18, 2007, in the Korean Intellectual Property Office, the entire contents of which are incorporated herein in their entirety by reference.

BACKGROUND

1. Field

Example embodiments relate to a proportional to absolute temperature (PTAT) current generation circuit, and for example, to a PTAT current generation circuit having a higher temperature coefficient, a display device including the same, and/or a method thereof.

2. Description of Related Art

Proportional to absolute temperature (PTAT) current generation circuits outputting PTAT current values are generally used with Inverse Proportional to absolute temperature (IPTAT) current generation circuits outputting IPTAT current values in reference bias circuits (e.g., bandgap circuits). PTAT current generation circuits generally use resistance elements to generate reference current. A resistance value of the resistance elements has a temperature coefficient (e.g., a positive temperature coefficient) which increases in proportion to temperature. The temperature coefficient is the relative change of resistance if temperature changes.

Because the resistance elements have the temperature coefficient proportional to temperature, the resistance value of the resistance elements increases if the temperature increases. Accordingly, current output from the PTAT current generation circuits may decrease if the temperature increases. For example, the characteristic of the temperature coefficient of the resistance elements may deteriorate the output current characteristics of the PTAT current generation circuits. As display devices have become larger, current consumed in driving units (e.g., source line drivers) for driving display devices increases, and therefore, an amount of heat generated increases.

For example, a source line driver precharges a plurality of source lines with a common voltage and transmits digital image data input from a timing controller to a corresponding one of the source lines. Because a precharge time decreases if temperature increases, the temperature of the source line increases. Accordingly, heat generated by a display panel including the source line may cause a malfunction.

SUMMARY

Example embodiments provide a proportional to absolute temperature (PTAT) current generation circuit having a higher temperature coefficient using a transistor operating in a weak inversion region.

Example embodiments provide a display device and/or a method for reducing heat generated by a display panel by controlling precharge time of a plurality of source lines based on a sensed temperature.

According to an example embodiment, a proportional to absolute temperature (PTAT) current generation circuit may include a current mirror unit and/or a level control unit. The current mirror unit may be connected between a first power supply voltage, a first node, and a second node. The level control unit may be connected between the first node, the second node, and a second power supply voltage. The level control unit may be configured to control a level of an output current of the current mirror unit based on a voltage level of the first node and a voltage level of the second node. The level control unit comprises a first transistor connected between the first node and the second power supply voltage, at least one second transistor connected between the second node and a third node, the at least one second transistor configured to operate in a weak inversion region, and/or a third transistor connected between the third node and the second power supply voltage.

According to an example embodiment, the current mirror unit may include a first current mirror and/or a second current mirror. The first current mirror may include a first transistor pair, which is connected between the first power supply voltage, a fourth node, and/or a fifth node. The first transistor pair may have a common gate. The second current mirror comprising a second transistor pair, which is connected between the first node, the second node, the fourth node, and/or the fifth node. The second current mirror may have a common gate.

According to an example embodiment, the PTAT current generation circuit may include an output unit configured to mirror the output current of the current mirror unit and output a mirrored current.

According to an example embodiment, the at least one second transistor may be controlled by a bias voltage and/or may be a metal-oxide semiconductor (MOS) transistor having a temperature coefficient inversely proportional to a temperature.

According to an example embodiment, the first transistor and the third transistor may be bipolar junction transistors.

According to another example embodiment, a display device may include a display panel, a timing controller, and/or a source line driver. The display panel may include a plurality of source lines and a plurality of gate lines. The timing controller may be configured to generate digital image data and a clock signal. The source line driver may be configured to drive the plurality of source lines based on the digital image data and the clock signal. The source line driver may include a digital-to-analog converter, an output buffer, a transmission switch unit, and/or a temperature sensing unit. The digital-to-analog converter may be configured to generate an analog voltage corresponding to the digital image data. The output buffer may be configured to buffer the analog voltage output from the digital-to-analog converter. The transmission switch unit may be configured to precharge each of the plurality of source lines with a precharge voltage in response to the clock signal and transmit an output signal of the output buffer to a corresponding source line of the plurality of source lines. The temperature sensing unit may be configured to sense a temperature, compare the sensed temperature with a reference temperature, and generate a control signal corresponding to a comparison result. The timing controller may control a pulse width of the clock signal based on the control signal.

According to an example embodiment, the timing controller may be configured to increase the pulse width of the clock signal at a second logic level if the temperature sensed by the temperature sensing unit is greater than the reference temperature.

According to an example embodiment, the timing controller may be configured to control the pulse width of the clock signal to increase a precharge time of the plurality of source lines if the temperature sensed by the temperature sensing unit is greater than the reference temperature.

According to an example embodiment, the transmission switch unit may include at least one common switch and/or at least one output switch. The at least one common switch may be configured to precharge each of the plurality of source lines with the precharge voltage in response to the clock signal. The at least one output switch may be configured to transmit the output signal of the output buffer to the corresponding one of the plurality of source lines in response to the clock signal. The at least one common switch and the at least one output switch may be complementarily switched in response to the clock signal.

According to an example embodiment, the temperature sensing unit may include a proportional to absolute temperature (PTAT) current generation circuit and/or a comparator. The proportional to absolute temperature (PTAT) current generation circuit may be configured to generate a current in proportion to the temperature. The comparator may be configured to compare an output voltage of the PTAT current generation circuit with a reference voltage and output the control signal corresponding to the comparison result.

According to an example embodiment, a method of driving a display device may include generating digital image data and a clock signal. An analog voltage corresponding to the digital image data may be generated. The analog voltage may be buffered. Each of a plurality of source lines may be precharged with a precharge voltage in response to the clock signal and an output signal may be transmitted to a corresponding source line among the plurality of source line. A temperature may be sensed and/or a pulse width of the clock signal may be controlled based on the sensed temperature.

According to an example embodiment, the controlling the pulse width may include generating a voltage in proportion to the temperature, comparing the generated voltage with a reference voltage, and generating a control signal corresponding to the comparison result, and/or controlling the pulse width based on the control signal.

BRIEF DESCRIPTION OF THE DRAWINGS

The above and/or other aspects and advantages will become more apparent and more readily appreciated from the following detailed description of example embodiments taken in conjunction with the accompanying drawings of which.

DETAILED DESCRIPTION OF EXAMPLE EMBODIMENTS

Figure 1:
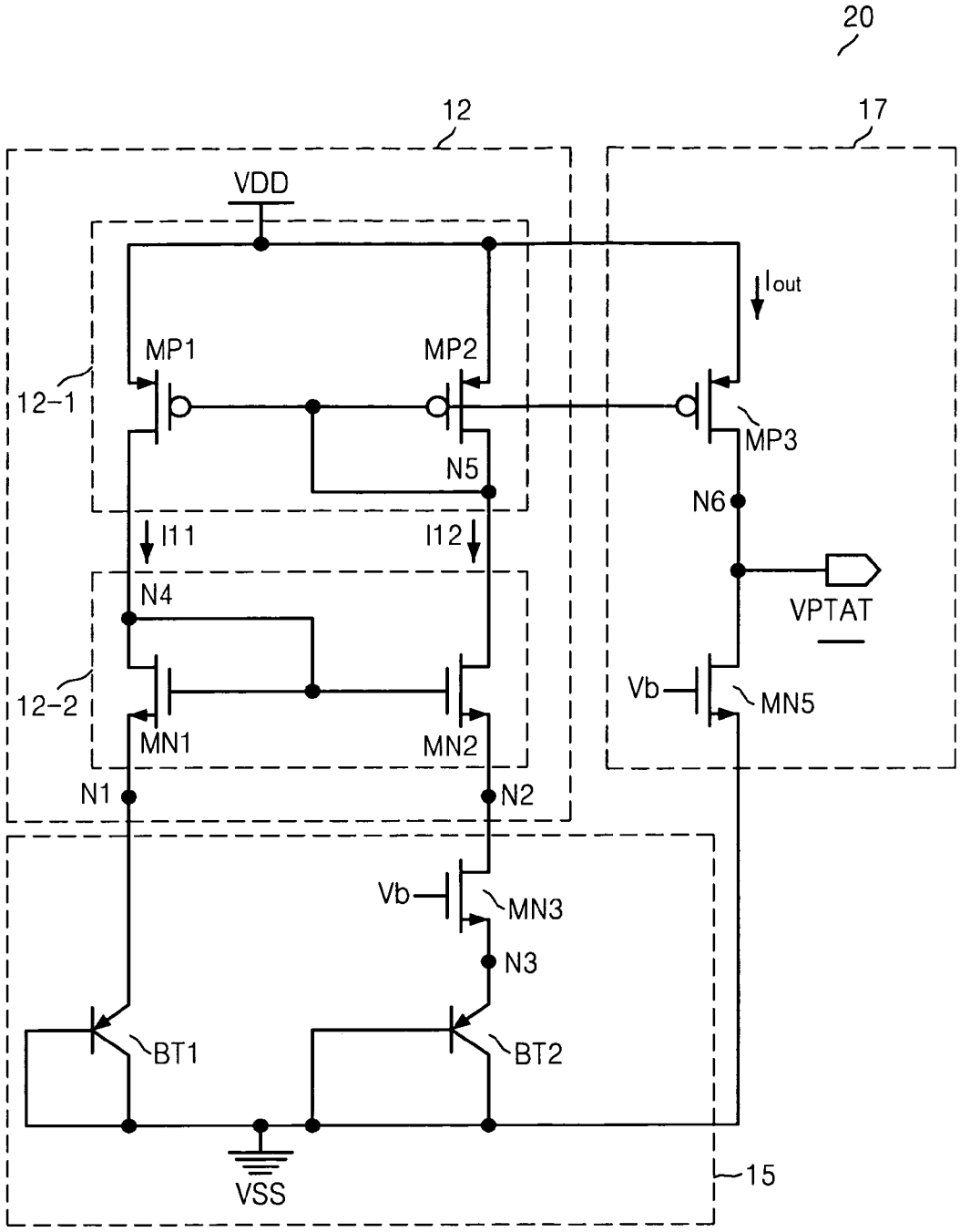
FIG. 1 illustrates a proportional to absolute temperature (PTAT) current generation circuit according to an example embodiment.

Example embodiments will now be described more fully hereinafter with reference to the accompanying drawings. Embodiments may, however, be in many different forms and should not be construed as being limited to the example embodiments set forth herein. Rather, these example embodiments are provided so that this disclosure will be thorough and complete, and will fully convey the scope to those skilled in the art. In the drawings, the thicknesses of layers and regions may be exaggerated for clarity.

It will be understood that when a component is referred to as being "on," "connected to" or "coupled to" another component, it can be directly on, connected to or coupled to the other component or intervening components may be present. In contrast, when a component is referred to as being "directly on," "directly connected to" or "directly coupled to" another component, there are no intervening components present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the example embodiments.

Spatially relative terms, such as "beneath," "below," "lower," "above," "upper" and the like, may be used herein for ease of description to describe one component or feature's relationship to another component(s) or feature(s) as illustrated in the drawings. It will be understood that the spatially relative terms are intended to encompass different orientations of the device in use or operation in addition to the orientation depicted in the figures.

The terminology used herein is for the purpose of describing particular example embodiments only and is not intended to be limiting. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, and/or components.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Reference will now be made to example embodiments, which are illustrated in the accompanying drawings, wherein like reference numerals refer to the like components throughout.

Figure 2:
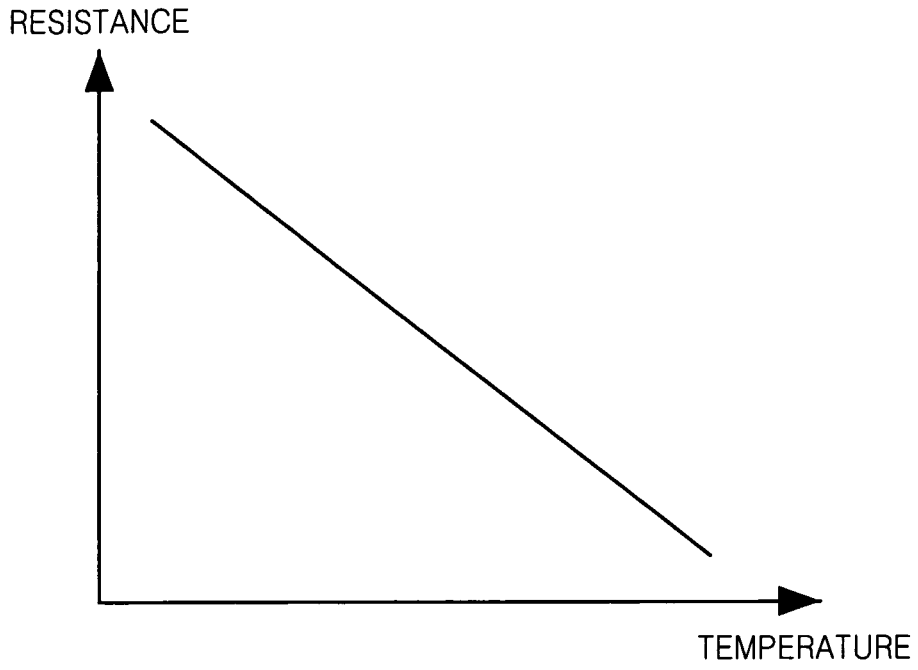
FIG. 2 is an example graph illustrating an example temperature coefficient of a second transistor illustrated in FIG. 1.

FIG. 1 illustrates a proportional to absolute temperature (PTAT) current generation circuit 20 according to an example embodiment. FIG. 2 is an example graph illustrating an example temperature coefficient of a second transistor illustrated in FIG. 1. Referring to FIGS. 1 and 2, the PTAT current generation circuit 20 may include a current mirror unit 12, a level control unit 15, and/or an output unit 17. It will be apparent that the PTAT current generation circuit 20 may be used for a reference voltage generation circuit and/or be widely used in semiconductor devices and other electronic devices which require PTAT current generation circuits.

The current mirror unit 12 may be connected between a first power supply voltage VDD, a first node N1, and/or a second node N2. The current mirror unit 12 may mirror a first current I11 flowing through the first node N1 and a second current I12 flowing through the second node N2. The current mirror unit 12 may include a first current mirror 12-1 and/or a second current mirror 12-2.

The first current mirror 12-1 may include a first transistor pair MP1 and MP2, which are connected between the first power supply voltage VDD and a fourth node and a fifth node, respectively. For example, transistor MP1 of the first transistor pair MP1 and MP2 may be connected between the first power supply voltage VDD and the fourth node N4, and transistor MP2 of the first transistor pair MP1 and MP2 may be connected between the first power supply voltage VDD and the fifth node N5. The first transistor pair MP1 and MP2 may have a common gate. The common gate of the first transistor pair MP1 and MP2 may be connected with the fifth node N5. The first transistor pair MP1 and MP2 may have a same channel width (W)/channel length (L) ratio (hereinafter referred to as a "W/L ratio"), but example embodiments are not limited thereto and the first transistor pair MP1 and MP2 may have different W/L ratios.

The second current mirror 12-2 may include a second transistor pair MN1 and MN2 which are connected between the first node N1, the second node N2, the fourth node N4, and the fifth node N5. For example, transistor MN1 of the second transistor pair MN1 and MN2 may be connected between the fourth node N4 and the first node N1, and transistor MN2 of the second transistor pair MN1 and MN2 may be connected between the fifth node N5 and the second node N2. The second transistor pair MN1 and MN2 may have a common gate. The common gate of the second transistor pair MN1 and MN2 may be connected with the fourth node N4. The second transistor pair MN1 and MN2 may have the same W/L ratio, but example embodiments are not limited thereto and the second transistor pair MN1 and MN2 may have different W/L ratios.

The level control unit 15 may be connected between the first node N1, the second node N2, and a second power supply voltage VSS, e.g., a ground voltage. The level control unit 15 may control a level of the output currents I11 and I12 of the current mirror unit 12 based on a voltage level of the first node N1 and a voltage level of the second node N2. The level control unit 15 may include a first transistor BT1, a second transistor MN3, and/or a third transistor BT2.

The first transistor BT1 may be connected between the first node N1 and the second power supply voltage VSS. The first transistor BT1 may be a bipolar junction transistor (BJT) which has an emitter connected with the first node N1 and a base and a collector which are connected with the second power supply voltage VSS.

The second transistor MN3 may be gated in response to a bias voltage Vb and form a current path between the second node N2 and a third node N3. FIG. 2 shows an ideal temperature coefficient of the second transistor MN3. The second transistor MN3 may operate in a weak inversion region, e.g., in a triode mode having a temperature coefficient (e.g., a negative temperature coefficient) in inverse proportion to a temperature, as illustrated in FIG. 2. The second transistor MN3 may have a resistance value in inverse proportion to the temperature. Accordingly, the second transistor MN3 may control the level of the second current I12 according to the temperature. For example, because the resistance of the second transistor MN3 decreases as the temperature increases, the second current I12 and the first current I11 resulting from mirroring the second current I12 may be increased. Accordingly, the PTAT current generation circuit 20 may generate an output current $I_{out}$ in proportion to the temperature, thereby having improved output characteristics. For example, the output current $I_{out}$ of the PTAT current generation circuit 20 according an example embodiment may have a larger variation with respect to the temperature than that of a conventional PTAT current generation circuits using resistance elements. For example, if the temperature changes from 75° C. to 125° C., an output voltage VPTAT of a conventional PTAT current generation circuit using resistance elements changes from about 1.75 V to about 2 V while the output voltage VPTAT of the PTAT current generation circuit 20 according to an example embodiment may change from about 1 V to about 2 V.

The third transistor BT2 may be connected between the third node N3 and the second power supply voltage VSS. The third transistor BT2 may be a BJT which has an emitter connected with the third node N3 and a base and a collector which are connected with the second power supply voltage VSS.

If a current flowing in the first transistor BT1 is M times a current flowing in the third transistor BT2, the third transistor BT2 may be a single transistor having an M-fold current (e.g., a transistor having a W/L ratio M times greater than the first transistor BT1) in order to equalize the first current I11 and the second current I12. If M is an integer, the third transistor BT2 may be implemented by M first transistors.

The output unit 17 may include a fifth transistor MP3 and a sixth transistor MN5. The output unit may convert the output current $I_{out}$ resulting from mirroring the first current I11 or the second current I12 and output the output voltage VPTAT in proportion to the temperature.

The fifth transistor MP3 may be gated with the voltage of the fifth node N5 and form a current path between the first power supply voltage VDD and a sixth node N6, thereby controlling the level of the output current $I_{out}$. The sixth transistor MN5 may be gated with the bias voltage Vb and form a current path between the sixth node N6 and the second power supply voltage VSS. The sixth transistor MN5 may convert the output current $I_{out}$ into the output voltage VPTAT and may control the level of the output voltage VPTAT. The sixth transistor MN5 and the second transistor MN3 may have a same W/L ratio, but example embodiments are not limited thereto and the sixth transistor MN5 and the second transistor MN3 may have different W/L ratios.

Figure 3:
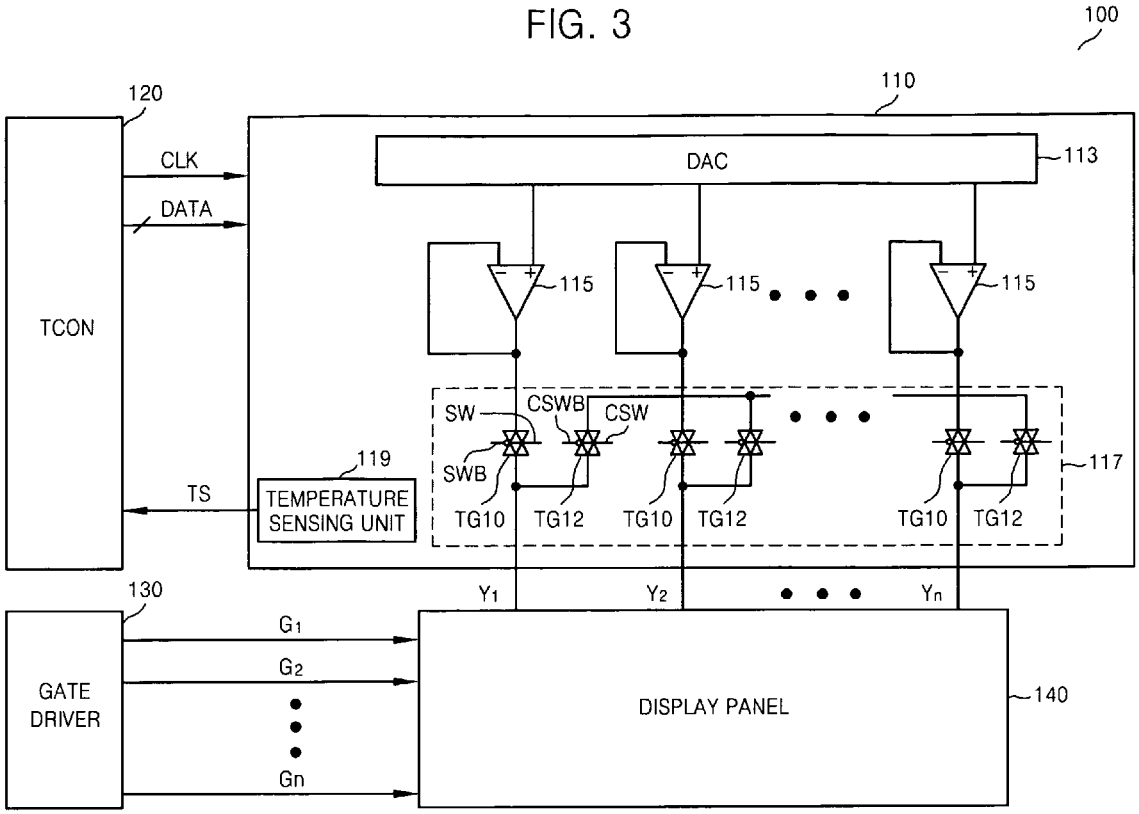
FIG. 3 illustrates a display device according to an example embodiment.
Figure 4:
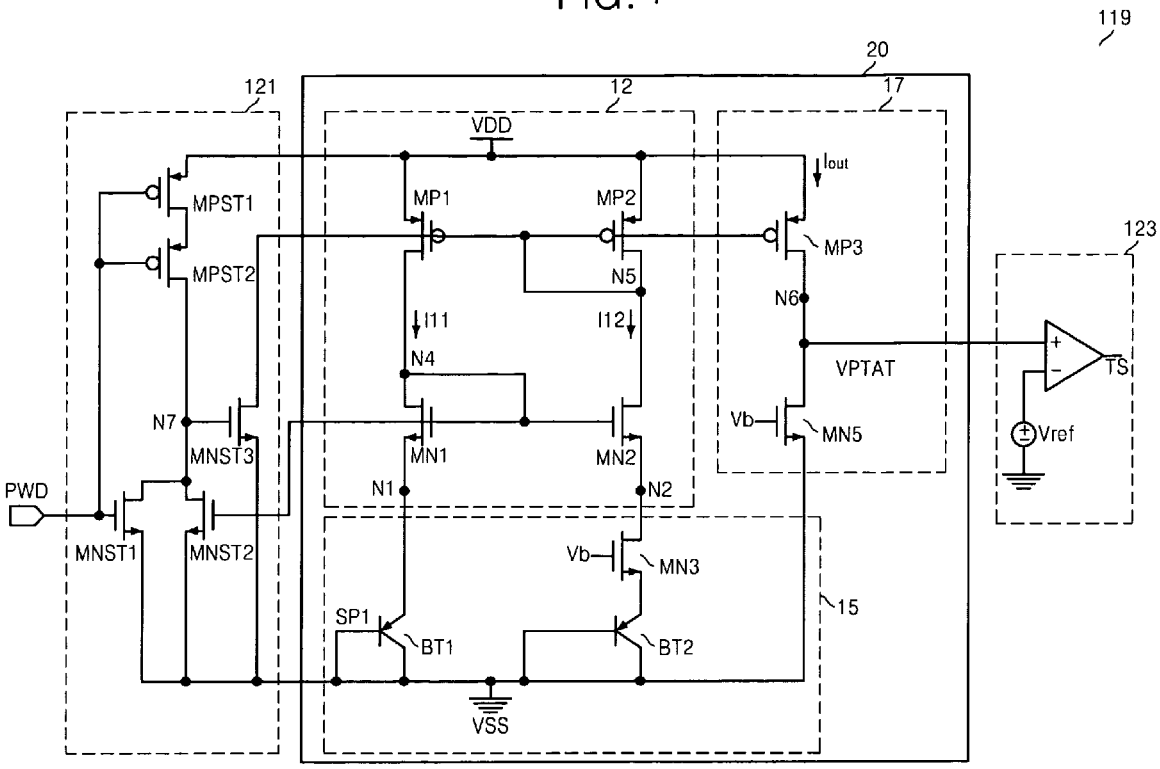
FIG. 4 illustrates a temperature sensing unit illustrated in FIG. 3.
Figure 5:
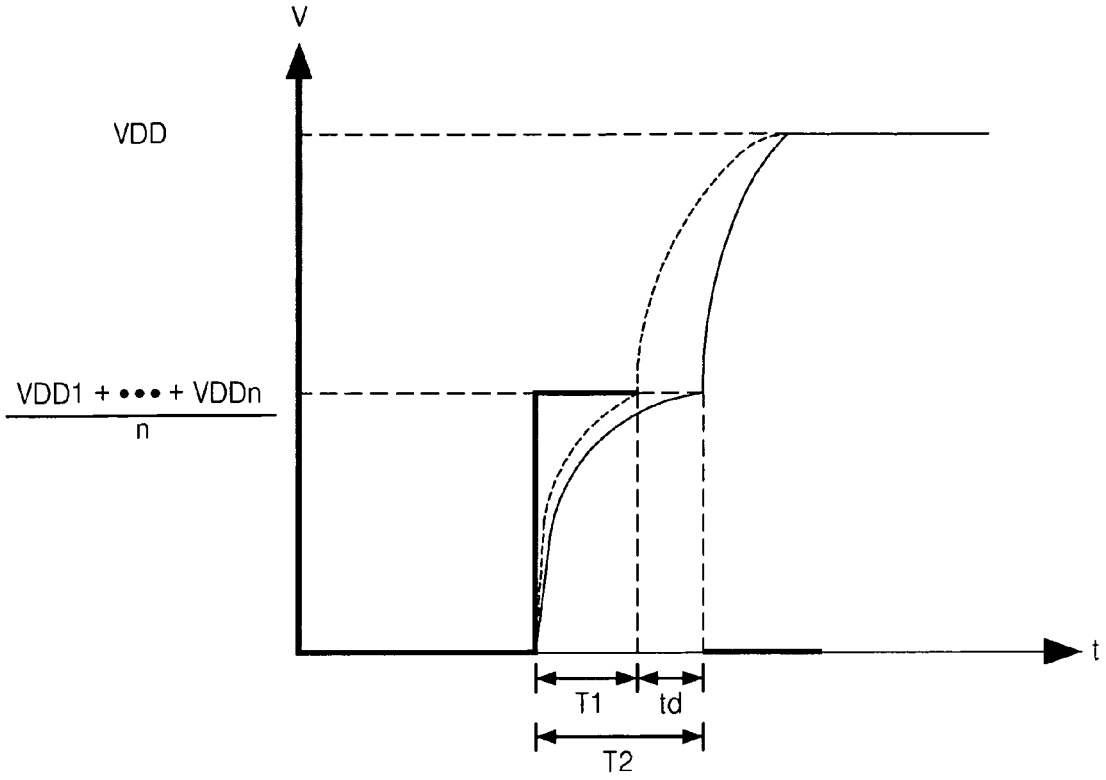
FIG. 5 illustrates an output voltage of a source line which varies with temperature sensed by the temperature sensing unit illustrated in FIG. 3.

FIG. 3 illustrates a display device 100 according to an example embodiment. FIG. 4 illustrates a temperature sensing unit 119 illustrated in FIG. 3. FIG. 5 illustrates an output voltage of a source line which varies with a temperature sensed by the temperature sensing unit 119 illustrated in FIG. 3. Referring to FIGS. 3 through 5, the display device 100 may include a source line driver 110, a timing controller 120, a gate driver 130, and/or a display panel 140.

The source line driver 110 may receive digital image data DATA and a clock signal CLK from the timing controller 120 and drive a plurality of source lines $Y_1, Y_2, \ldots, Y_n$ connected with the display panel 140. The source line driver 110 may include a digital-to-analog converter (DAC) 113, an output buffer 115, a transmission switch unit 117, and/or the temperature sensing unit 119.

The DAC 113 may generate an analog voltage corresponding to the digital image data DATA. The output buffer 115 may buffer the analog voltage output from the DAC 113. The output buffer 115 may control the slew rate of voltage applied to the source lines $Y_1$ through $Y_n$ based on a bias voltage, which may be different than the bias voltage Vb, (not shown) generated by a bias voltage generator (not shown).

The transmission switch unit 117 may precharge the source lines $Y_1$ through $Y_n$ with a precharge voltage in response to first switching signals CSW and CSWB and transmit the output signal of the output buffer 115 to a corresponding one of the source lines $Y_1$ through $Y_n$ in response to second switching signals SW and SWB. The first switching signals CSW and CSWB may have the same phase as the clock signals CLK and may be complementary with the second switching signals SW and SWB. The clock signal CLK may be used as a general reference synchronization signal, but example embodiments are not restricted thereto.

The transmission switch unit 117 may include at least one common switch TG12 and at least one output switch TG10. For example, the transmission switch unit may include a common switch TG12 and an output switch TG10 for each of the source lines $Y_1$ through $Y_n$, and the common switches TG12 may be connected in common and to respective source lines of the source lines $Y_1$ through $Y_n$. If the first switching signals CSW and CSWB are at a second logic level (e.g., a high level of "1") based on the clock signal CLK, e.g., if the clock signal CLK is at the second logic level, the at least one common switch TG12 may be turned on to precharge each of the source lines $Y_1$ through $Y_n$ with the precharge voltage. If the second switching signals SW and SWB are at the second logic level based on the clock signal CLK, e.g., if the clock signal is at a first logic level (e.g., a low level of "0"), the at least one output switch TG10 may transmit the output signal of the output buffer 115 to a corresponding one of the source lines $Y_1$ through $Y_n$. For example, the at least one common switch TG12 and the at least one output switch TG10 may be complementarily switched in response to the clock signal CLK.

The temperature sensing unit 119 may sense the temperature, compare the sensed temperature with a reference temperature, and/or generate a control signal TS corresponding to the comparison result. The temperature sensing unit 119 may include a start-up circuit 121, the PTAT current generation circuit 20 according to an example embodiment, and/or a comparator 123.

The start-up circuit 121 may enable an operation of the PTAT current generation circuit 20 in response to a power down signal PWD. The start-up circuit 121 may include ninth through thirteenth transistors MPST1, MPST2, MNST1, MNST2, and/or MNST3. The power down signal PWD may control the operation of the PTAT current generation circuit 20.

If the power down signal PWD is at the first logic level (e.g., the low level of "0"), the ninth transistor MPST1 and the tenth transistor MPST2, which are connected in series between the first power supply voltage VDD and a seventh node N7 and are gated with the power down signal PWD, may form a current path between the first power supply voltage VDD and the seventh node N7. The thirteenth transistor MNST3 may be gated with a voltage of the seventh node N7 and form a current path between the fifth node N5 and the second power supply voltage VSS, thereby gating the first transistor pair MP1 and MP2 with the voltage of the fifth node N5. Accordingly, the PTAT current generation circuit 20 may be enabled and generate the output current $I_{out}$ in proportion to the temperature.

If the power down signal PWD is at the second logic level (e.g., the high level of "1"), the eleventh transistor MNST1, which is gated with the power down signal PWD, may form a current path between the seventh node N7 and the second power supply voltage VSS. The twelfth transistor MNST2, which is gated with the voltage of the fourth node N4, may form a current path between the seventh node N7 and the second power supply voltage VSS, thereby lowering a potential of the voltage of the seventh node N7. Accordingly, the PTAT current generation circuit 20 may be disabled. The PTAT current generation circuit 20 has been described with reference to FIGS. 1 and 2, and therefore, detailed descriptions thereof will be omitted.

The comparator 123 may compare the output voltage VPTAT of the PTAT current generation circuit 20 with a reference voltage Vref corresponding to a reference temperature and generate the control signal TS corresponding to the comparison result. For example, the comparator 123 may output the control signal TS at the first logic level (e.g., the low level of "0") if the output voltage VPTAT of the PTAT current generation circuit 20 is less than the reference voltage Vref and may output the control signal TS at the second logic level (e.g., the high level of "1") if the output voltage VPTAT of the PTAT current generation circuit 20 is greater than the reference voltage Vref.

The timing controller 120 may generate the digital image data DATA and the clock signal CLK and control the pulse width of the clock signal CLK based on the control signal TS generated by the temperature sensing unit 119. For example, the timing controller 120 may not change the pulse width of the clock signal CLK is the control signal TS is at the first logic level (e.g., the low level of "0"), for example, if the temperature sensed by the temperature sensing unit 119 is less than the reference temperature. The timing controller 120 may increase the pulse width of the clock signal CLK, e.g., at the high level of "1", if the control signal TS is at the second logic level (e.g., the high level of "1"), for example, if the temperature sensed by the temperature sensing unit 119 is greater than the reference temperature.

As illustrated in FIG. 5, if the control signal TS is at the second logic level (e.g., the high level of "1"), a first period T1 of the clock signal CLK increases by a pulse width td. Accordingly, the at least one common switch TG12 may be turned on during the second period T2 of the clock signal CLK at the second logic level having the increased pulse width td. Therefore, the second period T2, during which each of the source lines $Y_1$ through $Y_n$ is precharged with a precharge voltage, e.g., VDD=(VDD1+, . . . +VDDn)/n, may become greater than the first period T1 and the at least one output switch TG10 may transmit the output signal of the output buffer 115 to a corresponding one of the source lines $Y_1$ through $Y_n$ in response to the clock signal CLK at the first logic level (e.g., the low level of "0") after the first period T1 lapses.

For example, the timing controller 120 may control the pulse width of the clock signal CLK according to an increase of the temperature to delay the precharge time and the transmission of the output signal, so that malfunctions caused by heat generation of the source line driver 110, the source lines $Y_1$ through $Y_n$, and/or the display panel 140 may be reduced.

The gate driver 130 may supply voltage to a plurality of gate lines $G_1, G_2, \ldots G_n$. The display panel 140 may include the gate lines $G_1$ through $G_n$ and the source lines $Y_1$ through $Y_n$ and may be driven by the source line driver 110 and/or the gate driver 130 to display images.

As described above, example embodiments may improve output characteristics of a PTAT current generation circuit using a transistor operating in a weak inversion region. Example embodiments may reduce malfunctions caused by heat generation of a display device by controlling a precharge time of a plurality of source lines based on a sensed temperature.

Although example embodiments have been shown and described in this specification and figures, it would be appreciated by those skilled in the art that changes may be made to the illustrated and/or described example embodiments without departing from their principles and spirit.

What is claimed is:

1. A Display Driver Integrated (DDI) circuit comprising:

a current mirror unit connected between a first power supply voltage, a first node, and a second node; and a level control unit connected between the first node, the second node, and a second power supply voltage, wherein the level control unit is configured to control a level of an output current of the current mirror unit based on a voltage level of the first node and a voltage level of the second node, and the level control unit comprises, a first transistor connected between the first node and the second power supply voltage, at least one second transistor connected between the second node and a third node, the at least one second transistor having a negative temperature coefficient such that a resistance of the at least one second transistor decreases as a temperature increases, the at least one second transistor being configured to operate in a weak inversion region, the weak inversion region being a mode in which a gate to source voltage of the at least one second transistor is less than a threshold voltage of the at least one second transistor, and a third transistor connected between the third node and the second power supply voltage, the at least one second transistor being a metal-oxide-semiconductor (MOS) transistor connected in series with the third transistor, wherein the current mirror unit comprises, a first current mirror comprising a first transistor pair, which is connected between the first power supply voltage, a fourth node, and a fifth node, the first transistor pair having a common gate, and a second current mirror comprising a second transistor pair, which is connected between the first node, the second node, the fourth node, and the fifth node, the second transistor pair having a common gate.

2. The DDI circuit of claim 1, further comprising:

an output unit configured to mirror the output current of the current mirror unit and output a mirrored current.

3. The DDI circuit of claim 2, wherein the output unit includes:

a fourth transistor configured to control a level of the mirrored current, and a fifth transistor configured to convert the mirrored current to an output voltage and control a level of the output voltage, the fourth and fifth transistors being metal-oxide-semiconductor (MOS) transistors.

4. The DDI circuit of claim 1, wherein the at least one second transistor is controlled by a bias voltage and has a temperature coefficient inversely proportional to a temperature.

5. The DDI circuit of claim 1, wherein the first transistor and the third transistor are bipolar junction transistors.

6. The DIN circuit of claim 1, wherein the at least one second transistor is configured to control the level of the output current of the current mirror unit according to a temperature.

* * * * *